US009434120B2

(12) United States Patent
Cailloux

(10) Patent No.: US 9,434,120 B2
(45) Date of Patent: Sep. 6, 2016

(54) WORKING DEVICE AND FOLDING AND GLUING MACHINE INCORPORATING SUCH A DEVICE

(75) Inventor: Lionel Cailloux, Naves-Parmelan (FR)

(73) Assignee: BOBST MEX SA (CH)

( * ) Notice: Subject to any disclaimer, the term of this patent is extended or adjusted under 35 U.S.C. 154(b) by 688 days.

(21) Appl. No.: 13/516,902

(22) PCT Filed: Dec. 10, 2010

(86) PCT No.: PCT/EP2010/007527

§ 371 (c)(1),
(2), (4) Date: Oct. 2, 2012

(87) PCT Pub. No.: WO2011/072824

PCT Pub. Date: Jun. 23, 2011

(65) Prior Publication Data

US 2013/0017939 A1 Jan. 17, 2013

(30) Foreign Application Priority Data

Dec. 17, 2009 (EP) ..... 09015617

(51) Int. Cl.

| | |
|---|---|
| ***B31B 1/02*** | (2006.01) |
| ***B31B 1/04*** | (2006.01) |
| ***B31B 1/06*** | (2006.01) |

(Continued)

(52) U.S. Cl.

CPC . *B31B 1/02* (2013.01); *B31B 1/04* (2013.01); *B31B 1/06* (2013.01); *B31B 1/74* (2013.01); *B31B 1/88* (2013.01); *B31B 2201/0247* (2013.01); *B31B 2201/0276* (2013.01);

(Continued)

(58) Field of Classification Search

CPC ..... B31B 1/88; B31B 2201/88
USPC ..... 198/410, 411, 417
See application file for complete search history.

(56) References Cited

U.S. PATENT DOCUMENTS

| | | | | |
|---|---|---|---|---|
| 3,647,044 A * | 3/1972 | Orstam | B65G 47/647 198/436 |
| 3,648,605 A * | 3/1972 | Hottendorf | B31B 1/12 101/183 |
| 4,604,083 A * | 8/1986 | Barny | B31B 1/74 493/28 |

(Continued)

FOREIGN PATENT DOCUMENTS

| | | | |
|---|---|---|---|
| DE | EP 1897698 A2 * | 3/2008 | B41J 3/28 |
| EP | 0 881 173 A1 | 12/1998 | |
| EP | 1897698 A2 * | 3/2008 | B41J 13/12 |

OTHER PUBLICATIONS

International Search Report dated May 27, 2011 issued in corresponding international patent application No. PCT/EP2010/007527.

*Primary Examiner* — Thanh Truong
*Assistant Examiner* — Patrick Fry
(74) *Attorney, Agent, or Firm* — Ostrolenk Faber LLP

(57) ABSTRACT

A working device (1) to be used on blanks running essentially in a planar manner within a folding and gluing machine, with the outer printable surface originally oriented downwards. First turning device (10) turns over each blank so as to position its outer surface on the top. A transport device (20) moves each blank with the outer surface on the top. An action device (30) implements at least one of printing the outer surface of each blank on the one hand and monitoring the outer surface of each blank on the other hand, while the outer surface is facing up. A second turning device (40) turns over each blank again in order to reposition its outer surface downward.

11 Claims, 4 Drawing Sheets

(51) Int. Cl.

| | |
|---|---|
| ***B31B 1/74*** | (2006.01) |
| ***B31B 1/88*** | (2006.01) |
| ***B41J 3/28*** | (2006.01) |

(52) U.S. Cl.
CPC .... *B31B2201/0294* (2013.01); *B31B 2201/88* (2013.01); *B31B 2201/95* (2013.01); *B41J 3/28* (2013.01)

(56) References Cited

U.S. PATENT DOCUMENTS 5,413,327 A * 5/1995 Reymond ..... B31B 1/02 271/251
6,913,135 B2 * 7/2005 Borderi ..... B65G 47/082 198/418.7

* cited by examiner

WORKING DEVICE AND FOLDING AND GLUING MACHINE INCORPORATING SUCH A DEVICE

CROSS-REFERENCE TO RELATED APPLICATIONS

The present application is a 35 U.S.C. §§371 national phase conversion of PCT/EP2010/007527 filed Dec. 10, 2010, which claims priority of European Application No. 09015617.5, filed Dec. 17, 2009, the contents of which are incorporated by reference herein. The PCT International Application was published in the French language.

The present invention relates to a working device that can be used to print and/or check blanks intended to be folded and glued to form cartons.

The invention also relates to a folding and gluing machine incorporating such a working device.

The invention is particularly advantageously applicable in the field of packaging.

In the industry, cartons are conventionally manufactured in line, by folding and gluing blanks using machines commonly called folders-gluers. In order to be able to operate at high rates, these machines are usually arranged to feed the blanks continuously.

In practice, the blanks are generally packaged in a stack, and inserted one by one from the bottom of the stack. Physically, conveyor belts drive the blank placed at the base of the stack, and a system of gauges blocks the blanks placed directly above this base blank. In order to prevent the ends of the gauges from marking the external face of the blanks, commonly called printed face, said blanks are stacked and therefore fed with their external faces positioned underneath.

This type of folder-gluer, however, presents the drawback of making any operation on the external face of the blanks difficult, during the inline folding and gluing process. Notable among these operations are printing operations and/or quality control operations.

In practice, printing from above can be considered only when the external face is accessible from above, that is to say, once the carton has been folded and glued. However, at that moment, the available surface is significantly reduced since only half of the blank is facing upward. This solution is therefore inappropriate for working on the entire external face of the blank.

Nor does printing from below constitute a viable solution, given that it imposes implementing printing and/or checking means directly under the blanks. Now, because of gravity, dirt naturally tends to clog each print head and each control sensor used, with, ultimately, the risk of rendering them non-functional.

Thus, the technical issue to be resolved by the subject of the present invention is how to propose a working device for working on blanks circulating substantially flat with their external face underneath, within a folding and gluing machine responsible for manufacturing cartons from the blanks, a working device that would prevent the problems of the state of the art by offering the capacity to print and/or check each blank at any point over its external face during the conventional carton manufacturing process, while offering a perfect level of reliability.

SUMMARY OF THE INVENTION

The solution to the technical issue raised comprises, according to the present invention, in having the working device comprise first turnover means able to turn over each blank in order to position its external face upward, transport means which are placed downstream of the first turnover means and which are able to displace each blank with its external face upward, action means able to accomplish at least one of the functions comprising printing the external face of each blank on the one hand, and in checking the external face of each blank on the other hand, during the displacement of the blank by the transport means, and second turnover means which are placed downstream of the transport means and which are able to turn over each blank in order to reposition its external face downward.

It is understood that, throughout this text, the concept of checking should be understood in the broad sense of the term, that is to say, that it may relate to print quality, and/or the positioning of the print relative to the edges of the blank, and/or the shapes and dimensions of the blank, and/or the possible presence of holes and other defects of appearance, etc.

The same applies with regard to the concept of printing which does not take account of the reproduction technique physically implemented, and/or the surface of the external face which is actually involved. Also in practice, it will mostly concern an additional print rather than a full print, given that the blanks used are conventionally preprinted on their external faces.

The principle of the invention therefore consists in turning over each blank a first time in order to be able to access its external face from above, then turning over each blank again so as to enable it to follow the conventional carton manufacturing process which, as a reminder, imposes a downward positioning of said external face.

Whatever the case, the invention as thus defined offers the advantage of being able to print and/or check the external face of blanks, within the very folding and gluing machine which is designed to manufacture cartons from blanks circulating with the external face underneath.

Another major benefit of the invention lies in the fact that the printing and/or checking can be done at any point on the external face of each blank. The intervention of the action means occurs in fact at the moment when the external face is entirely accessible, that is to say, when the carton is not yet constructed but still in the blank state.

Finally, the invention makes it possible to employ action means installed above the blanks, and consequently working from above. This offers the advantage of limiting the problems of clogging on each print head and each checking sensor used. Ultimately, the risks of malfunctions or failures are significantly mitigated, to the benefit of the overall reliability of the working device.

The present invention also relates to the features that will emerge from the following description, and which must be considered in isolation or according to all their possible technical combinations.

BRIEF DESCRIPTION OF THE INVENTION

This description, given as a nonlimiting example, is intended to give a better understanding of what the invention consists of and how it may be implemented. The description is also given with reference to the appended drawings in which.

DESCRIPTION OF THE EMBODIMENTS

For clarity, the same elements are designated by the same references. Similarly, only those elements essential for understanding the invention are represented, but without regard to scale, and schematically.

Figure 1:
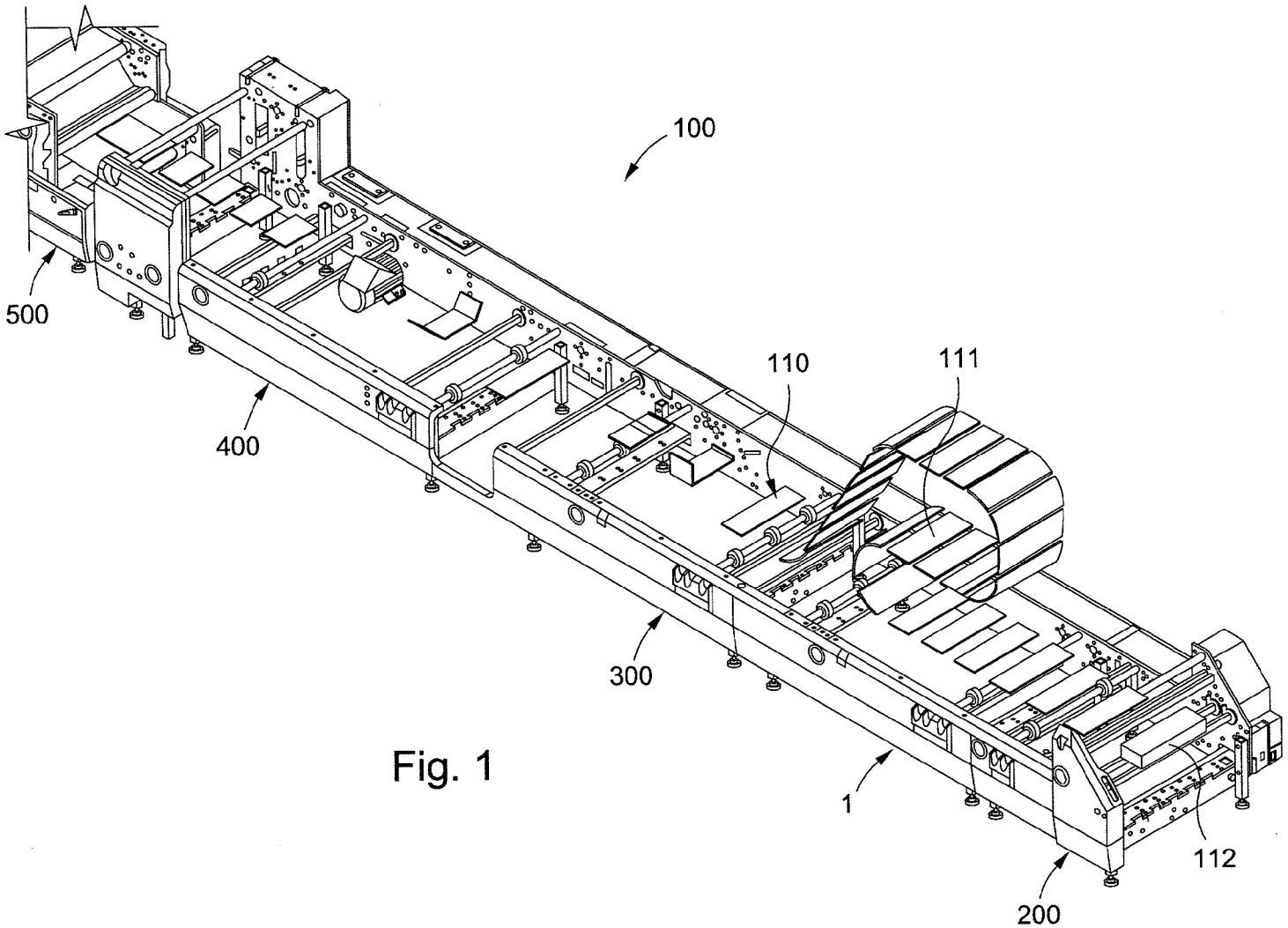
FIG. 1 illustrates a folding and gluing machine incorporating a working device conforming to a first embodiment of the invention.
Figure 2:
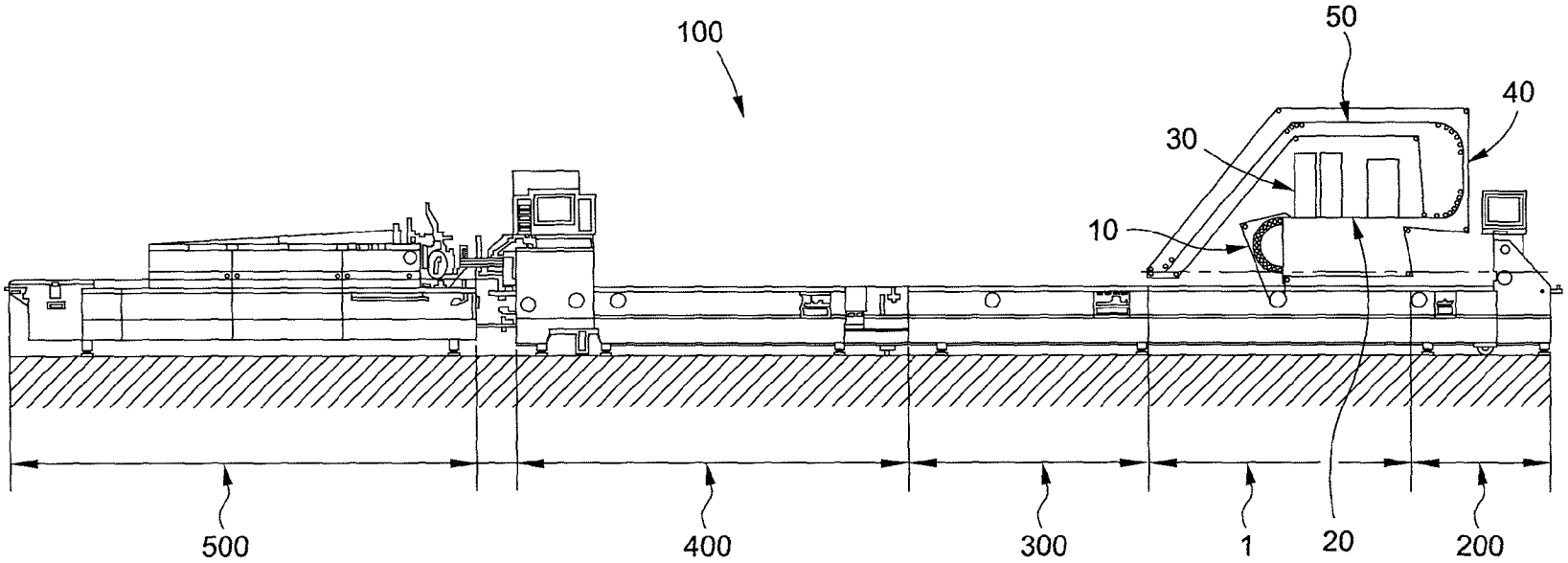
FIG. 2 is a side view of the folding and gluing machine represented in FIG. 1.

FIGS. 1 and 2 illustrate a folding and gluing machine 100 which is designed to manufacture cartons from cardboard blanks 110 which circulate within said machine 100, substantially flat and external face 111 underneath. Conventionally, this folding and gluing machine 100 has a modular structure. It in fact is comprised of several workstations 200, 300, 400, 500 which are juxtaposed but interdependent on one another to form a unitary whole.

There is thus a feeder 200 for feeding the machine 100 one blank at a time from a stack 112, a breaking machine 300 which pre-breaks some of the folds to 180° then re-opens each blank 110, a folding and gluing station 400 which, as its name implies, is responsible for gluing and folding each blank 110, and finally a receiving station 500, the function of which is to collect the flat folded cartons, and keep them pressed against one another in order to allow the glue to dry. These various workstations 200, 300, 400, 500 are well known from the state of the art, so they will not be described further here, either with regard to their structures or their respective operation.

However, FIGS. 1 and 2 also show that the folding and gluing machine 100 also incorporates a working device 1 which is more particularly responsible for intervening on the external face 111 of the blanks 110. In this particular embodiment, chosen solely as an example, the role of the working device 1 consists in both printing the external face 111 of each blank 110, and in then checking the print quality.

According to the subject of the present invention, the working device 1 is first of all provided with first turnover means 10 which are able to turn over each blank 110 so as to position its external face 111 uppermost. However, the working device 1 is also provided with transport means 20 which are placed downstream of the first turnover means 10, and which are able to displace each blank 110 with its external face 111 facing upward. The working device 1 then comprises action means 30 which are able to print the external face 111 of each blank 110 in a first step, then to check the print quality of said external face 111 in a second step; these two successive operations being performed during the displacement of said blank 110 by the transport means 20. Finally, the working device 1 has second turnover means 40 which are placed downstream of the transport means 20, and which are able to turn over each blank 110 in order to reposition its external face 111 underneath.

Figure 3:
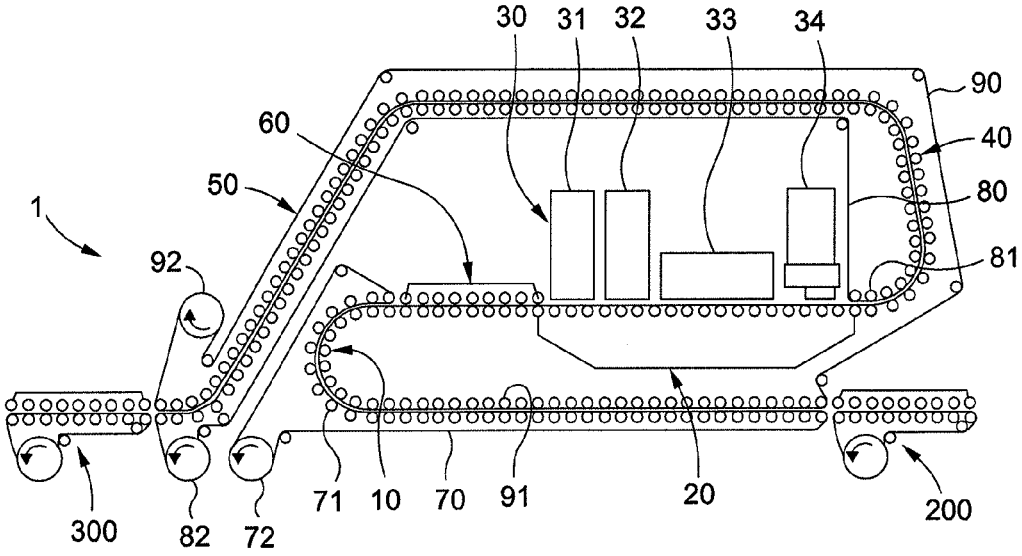
FIG. 3 shows in detail the working device with which the folding and gluing machine of FIGS. 1 and 2 is equipped.

As can be seen more clearly in FIG. 3, the working device 1 conforms to a first embodiment of the invention.

According to a particular feature of this first embodiment, the first turnover means 10 are able to displace each blank 110 along a trajectory describing an upwardly-oriented flat half-loop (FIG. 1).

This first turnover is therefore done by continuous displacement of the blank 110, so that the first turnover means 10 can be likened to transport means. The trajectory followed by the blank 110 may a priori be of any form, that is to say, primarily flat, curvilinear and not necessarily purely circular, provided, obviously, that it ultimately forms a half-loop. It is in fact important that, at the end of the turnover, the blank 110 is in position to continue its displacement in a direction which is parallel but opposite to the initial direction of displacement with which it came into contact with the first turnover means 10. Whatever the case, after this first turnover, the blank 110 is still substantially horizontal but this time with its external face 111 oriented upward.

According to another particular feature of the first embodiment, the second turnover means 40 are also able to displace each blank 110 along a trajectory describing an upwardly-oriented flat half-loop (FIG. 1).

Moreover, the comments given concerning the first turnover apply here in a fairly similar manner. The only notable differences are that, at the end of this second turnover, the blank 110 is in position to continue its displacement in a direction which is parallel but identical to its initial direction of displacement, and that its external face 111 is once again oriented downward.

In a particularly advantageous manner, the trajectory followed by each blank 110 during a turnover is preferably substantially semi-circular. It should be noted that this feature may apply equally to the displacement generated by the first turnover means 10 and for that provided by the second turnover means 40.

This means that, at the moment of each turnover, the displacement movement of the blank 110 corresponds to a rotation of almost 180° about an axis which is perpendicular to the initial direction of displacement of said blank 110. Since the circular half-loop-shaped trajectory is regular, the displacement movement of the blank 110 may be uniform, which equally facilitates the turnover.

As can be seen in FIG. 3, in this first embodiment of the invention, the displacement trajectory associated with the first turnover means 10 is purely semi-circular, whereas that corresponding to the second turnover means 40 is a little more ovalized. In this latter case, this is due to the need to leave sufficient space for the installation of the action means 30 above the transport means 20.

In accordance with another advantageous feature, the trajectory followed by each blank 110 during a turnover is in a plane that is substantially perpendicular to the plane of displacement of said blank 110 before said turnover. Once again, this feature may apply equally to the displacement generated by the first turnover means 10 and to that provided by the second turnover means 40.

The benefit of such a property is to guarantee that the various displacements of the blank 110, within the working device 1, will all take place on coplanar trajectories which extend in the vertical plane of the folding and gluing machine 100. This ultimately makes it possible to be able to have a working device 1 whose transversal footprint does not exceed that of the folding and gluing machine 100.

Thus, in this first embodiment of the invention, the idea is tantamount to displacing each blank 110 along a trajectory in the form of an S. The benefit of this solution is to remain within the plane of the machine 100, which allows for a simpler embodiment.

According to another particular feature of the first embodiment, the working device 1 is also provided with additional transport means 50 which are placed downstream of the second turnover means 40, and which are able to bring each blank 110 to the level of the initial plane of displacement in which it was circulating before the first turnover means 10. This feature makes it possible to make the working device 1 a genuine module, that is to say, an assembly capable of being incorporated, without any major adaptation, in a standard folding and gluing machine 100.

As can be clearly seen in FIG. 3, the transport means 20 are arranged to displace each blank 110 in a substantially horizontal plane.

In a particularly advantageous manner, the transport means 20 are able to secure each blank 110 from beneath. This feature makes it possible to leave the external face of the blank entirely accessible. The printing and/or the checking by the action means 30 can thus be done at any point on the external face.

In accordance with another advantageous feature that can be seen in FIG. 3, the working device 1 also comprises first alignment means 60 which are placed downstream of the first turnover means 10, and which are able to realign each blank 110 before the intervention of the action means 30. The presence of these first alignment means 60 enable the operations that will take place just after, namely the printing and the checking, demand a very high accuracy.

In a fairly similar manner, and although this is not the case here, the working device 1 could also have second alignment means downstream of the second turnover means 40. Their function would then be to realign each blank 110 before it leaves the working device 1. The presence of such second alignment means is less relevant than previously, given that the operation which must follow, namely the folding, requires a significantly lower level of accuracy.

According to a particular feature of the invention that is not represented but is perfectly compatible with the first embodiment of the invention of FIGS. 1 to 3, the working device 1 may be provided with diversion means that are able to directly displace each blank 110 from a starting position situated upstream of the first turnover means 10, to an arrival position situated downstream of the additional transport means 50.

This feature makes it possible to short-circuit the working device 1, by diverting the flow of the blanks 110 even before the latter arrive at the first turnover means 10, and by reintroducing it at the output of the working device 1. Such a functionality comes into its own for certain jobs which require neither printing nor checking. Whatever the case, this confers a very wide flexibility on the folding and gluing machine 100 as a whole.

In the exemplary embodiment of FIGS. 1 to 3, the first turnover means 10, the second turnover means 40 and the additional transport means 50 are comprised of conventional parts. In practice, all use the combined action of a number of belts 70, 80, 90 which are guided by a plurality of rollers 71, 81, 91 that are appropriately distributed, and that are driven displacement-wise by a motor shaft 72, 82, 92.

Thus, there is first of all a first belt 70 which cooperates with a plurality of rollers 71 and with a motor shaft 72, and which is essentially associated with the first turnover means 10. There can also be seen the presence of a second belt 80 which cooperates with a plurality of rollers and with a motor shaft 82, and which is essentially associated with the second turnover means 40. Finally, the existence of a third belt 90 will be noted, said belt cooperating with a plurality of rollers 91 and with a motor shaft 92, and being associated both with the first turnover means 10 and with the second turnover means 40.

As for the action means 30, these comprise a first print head 31, a second print head 32, a drying member 33 and an optical checking sensor 34.

Figure 4:
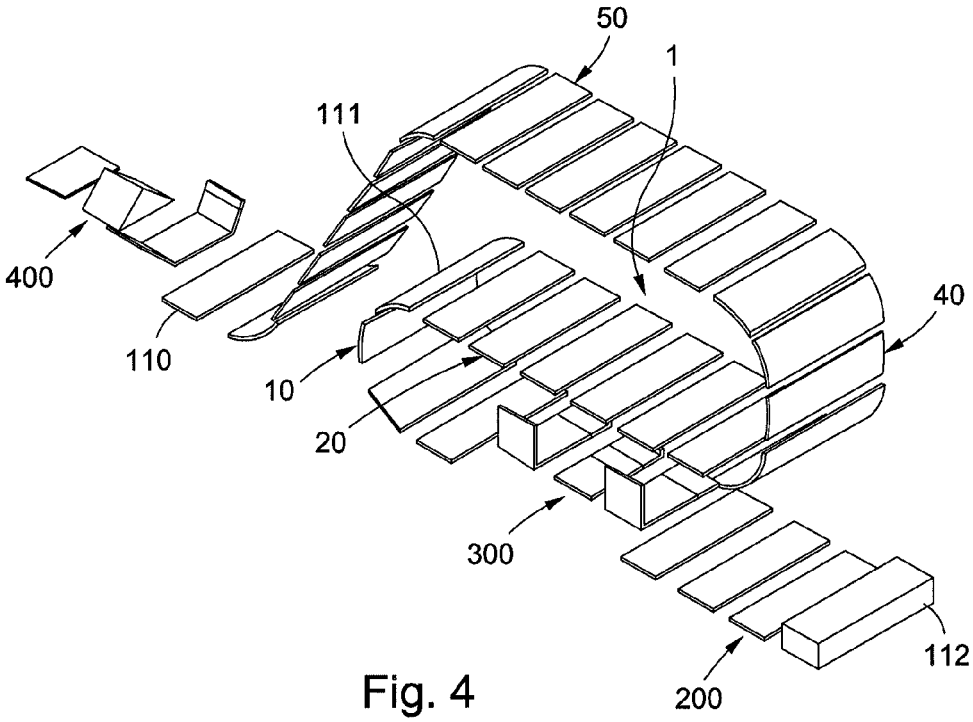
FIG. 4 illustrates the circulation of blanks within a working device which conforms to the first embodiment, but which is incorporated in a folding and gluing machine arranged differently from that of FIGS. 1 to 3.

In the exemplary embodiment of FIGS. 1 to 3, the working device 1 is incorporated between the feeder 200 and the breaking station 300. FIG. 4 shows a particularly advantageous variant layout, which is noteworthy in that the working device 1 is this time inserted between the breaking station 300 and the folding and gluing station 400. The major benefit of such a layout is that it somewhat allows for the breaking station 300 to be incorporated under the working device 1, which makes it possible to significantly compact the whole longitudinally. With the positioning of the first turnover means 10 just after the pre-breaking of the folds, it is also possible to advantageously use the first bend to perfectly straighten each blank 110.

It should be noted that FIG. 4 is an extremely schematic illustration given that, simply for reasons of clarity, only the circulation of the blanks 110 within a working device has been represented. This is why the arrows of most of the references do not point to structural elements, but the respective placements of the latter relative to the circulation flow of the blanks 110.

Figure 5:
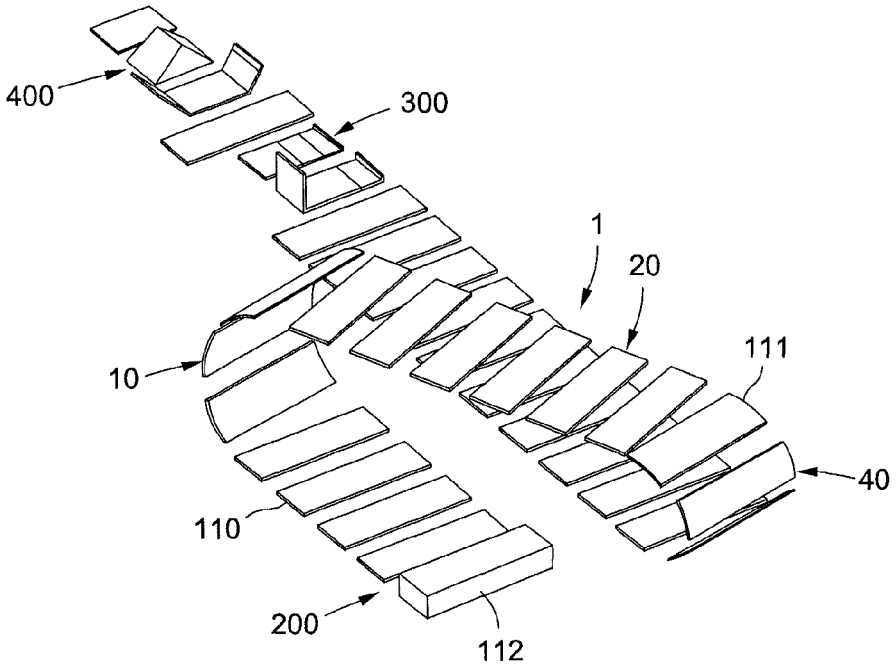
FIG. 5 shows the circulation of blanks within a working device conforming to a second embodiment of the invention.

FIG. 5 illustrates a second embodiment of the invention. This is also a schematic illustration, which shows only the circulation of the blanks 110 within a working device 1.

According to a particular feature of this second embodiment, the first turnover means 10 are able to displace each blank 110 along a trajectory describing a substantially helical and upwardly-oriented half-loop. In other words, the trajectory followed by the blank 110 is not flat but corresponds to a left-hand curved arc in the form of a half-loop.

According to another particular feature of this second embodiment, the second turnover means 40 are able to displace each blank 110 along a trajectory describing a substantially helical and downwardly-oriented half-loop.

Preferably, the trajectory followed by each blank 110 during a turnover is in the form of a helical segment. Once again, the feature can be applied immaterially to the displacement generated by the first turnover means 10, and/or to that provided by the second turnover means 40.

At the moment of each turnover, the displacement of the blank 110 follows a movement simultaneously combining a rotation and a translation according to one and the same axis which extends perpendicularly to the axis of the folding and gluing machine 100. The trajectory of displacement of the blanks 110 is like a circular half-loop, but the latter is inscribed in the three dimensions of space. This means that, independently of the turnovers, the trajectory is transversely offset as the blanks 110 advance within the working device 1.

It should be noted that, in this second embodiment, given the helical nature of the turnover trajectories of the blanks 110, it is particularly advantageous to provide alignment means both downstream of the first turnover means 10 and downstream of the second turnover means 40.

FIG. 5 clearly shows that this second embodiment is tantamount to having each blank 110 complete a kind of loop that is slightly eccentric, thereby causing a lateral offset of the circulation flow. Such a solution consequently makes it possible to advance the feeder 200, and therefore reduce the length of the machine 100 as a whole, even if it is a little to the detriment of the width. Another advantage relates to the fact that the second embodiment makes it possible to improve the accessibility to the pre-breaking region and to the printing and/or quality control region.

Figure 6:
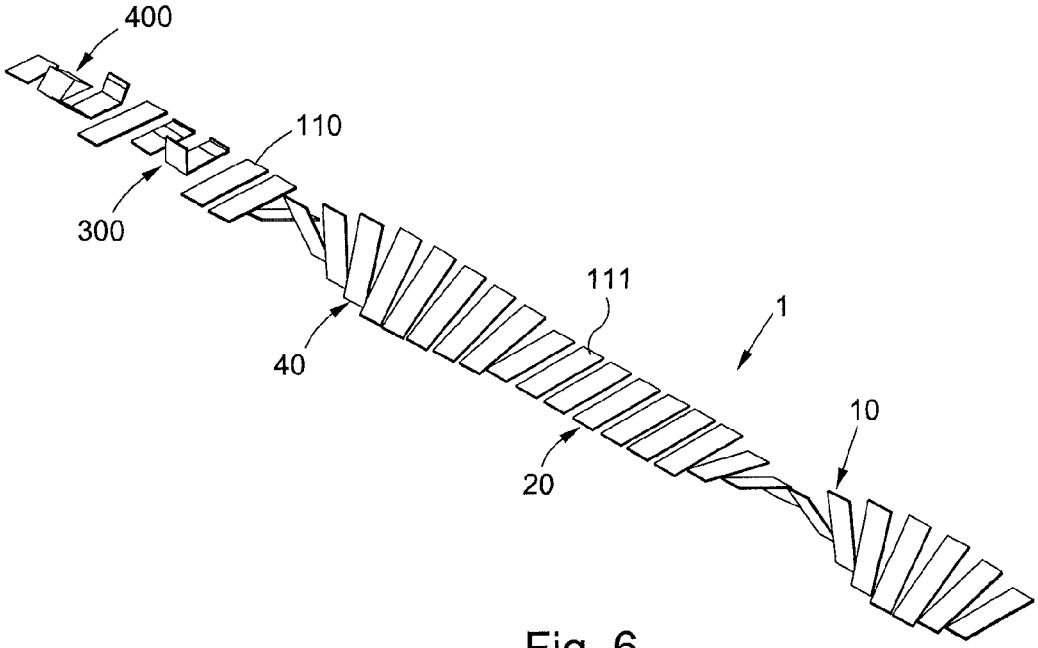
FIG. 6 shows the circulation of blanks within a working device conforming to a third embodiment of the invention.

FIG. 6 shows a third embodiment of the invention. Once again, it is a schematic illustration in which only the flow of the blanks 110 within the working device 1 has been represented.

According to a particular feature of this third embodiment, the first turnover means 10 are able to displace each blank 110 by a movement combining a translation and a rotation relative to one and the same axis which is parallel to the general direction of advance of the blanks 110 within the working device 1.

In such a displacement movement, the rotation is used directly for the turnover, whereas the translation is used to preserve the continuous nature of the working process which is conducted within the working device 1. It should, moreover, be noted that, since the rotation is close to 180°, it may be done immaterially in the clockwise direction or in the anticlockwise direction as in the example of FIG. 6.

According to another particular feature of this third embodiment, the second turnover means 40 are also able to displace each blank 110 by a movement combining a translation and a rotation relative to one and the same axis which is parallel to the general direction of advance of the blanks 110 in the working device 1.

Thus, and to simplify, the principle of the third embodiment consists in having each blank 110 describe two turns in the axis of the machine 100. The major benefit of this solution is that it offers perfect accessibility, given that all of the carton manufacturing process is then at the same level.

Obviously, the invention relates more generally to any folding and gluing machine 100 capable of manufacturing cartons from blanks 110 circulating substantially flat and with the external face 111 underneath, and comprising at least one working device 1 as described previously.

It is known that, by definition, this kind of folding and gluing machine 100 always incorporates a station 400 for folding and gluing the blanks 110. Also, and according to a particular feature of the invention, the working device 1 is preferably placed upstream of said folding and gluing station 400, in accordance with the exemplary embodiment of FIGS. 1 to 3.

These three representations clearly show that, in the case where the folding and gluing machine 100 also has a station 300 for breaking the blanks 110, which is positioned upstream of the folding and gluing station 400, the working device 1 may be placed upstream of said breaking station 300.

For its part, FIG. 4 shows that, with the same starting hypothesis, that is to say the presence of a station 300 for breaking the blanks 110 upstream of the folding and gluing station 400, it is also possible to insert the working device 1 between said breaking station 300 and said folding and gluing station 400. This is also a preferred embodiment, because of the gain in longitudinal compactness obtained.

The invention claimed is:

1. A folding and gluing machine for the production of cartons from blanks, the blanks having an external face, the blanks circulating flat in a plane of displacement and with the external face underneath, comprising at least one working device for working on the external face of the blanks, the working device comprising:

a first turnover device for turning over the entire blank in order to position the external face uppermost, by displacing each of the blanks along a trajectory that is perpendicular to the plane of displacement of the blank before the turnover, the trajectory describing a first upwardly-oriented half-loop;

a first transport device placed downstream of the first turnover device configured to displace each of the blanks with its external face uppermost;

an action device for accomplishing at least one of the functions comprising, during the displacement of the blank by the first transport device, printing the external face of each of the blanks and checking the external face of each of the blanks;

a second turnover device placed downstream of the first transport device which turns over the entire blank in order to reposition the external face underneath, by displacing each of the blanks along a trajectory which is in a plane that is perpendicular to the plane of displacement of the blank before the turnover, the trajectory describing a second upwardly-oriented half-loop; and wherein the first turnover device, the first transport device and the second turnover device displace each of the blanks along a trajectory within a plane of the machine that is perpendicular to the plane of displacement of the blank before the turnover; and a second transport device downstream of the second turnover device, which brings the entire blank to the level of the initial plane of displacement in which the blank was circulating before the first turnover device.

2. A folding and gluing machine according to claim 1, wherein the first turnover device displaces each blank along a trajectory describing a helical and upwardly-oriented half-loop.

3. A folding and gluing machine according to claim 1, wherein the second turnover device displaces each blank along a trajectory describing a helical and upwardly-oriented half-loop.

4. A folding and gluing machine according to claim 1, wherein the second transport device displaces each blank in a horizontal plane.

5. A folding and gluing machine according to claim 1, wherein the second transport device secures each blank from beneath the blank.

6. A folding and gluing machine according to claim 1, further comprising a first alignment device downstream of the first turnover device, and the first alignment device realigns each blank before the intervention of the action device.

7. A folding and gluing machine according to claim 1, further comprising a folding and gluing station for the blanks, and the working device is upstream of the folding and gluing station.

8. A folding and gluing machine according to claim 7, wherein the machine further comprises a station for breaking the blanks and located upstream of the folding and gluing station, and the working device is located upstream of the breaking device.

9. A folding and gluing machine according to claim 7, wherein the machine further comprises a station for breaking the blanks and located upstream of the folding and gluing station, and the working device is inserted between the breaking device and the folding and gluing station.

10. A folding and gluing machine according to claim 1, wherein the first turnover device displaces each blank along a trajectory which is semi-circular.

11. A folding and gluing machine according to claim 1, wherein the second turnover device displaces each blank along a trajectory which is semi-circular.

* * * * *